US006889674B2

(12) United States Patent
Pateman et al.

(10) Patent No.: US 6,889,674 B2
(45) Date of Patent: May 10, 2005

(54) COMBINED SHUT-OFF VALVE AND COVER FOR AN ENGINE BREATHER SYSTEM

(75) Inventors: Richard Pateman, Peterborough (GB); Maciej Bedkowski, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 10/616,522

(22) Filed: Jul. 10, 2003

(65) Prior Publication Data

US 2004/0035403 A1 Feb. 26, 2004

(30) Foreign Application Priority Data

Aug. 22, 2002 (EP) ..... 02255863

(51) Int. Cl.[7] ..... F02B 25/06
(52) U.S. Cl. ..... 123/574
(58) Field of Search ..... 123/572–574, 123/41, 86

(56) References Cited

U.S. PATENT DOCUMENTS 4,205,642 A * 6/1980 Nishimura et al. ..... 123/574
4,606,321 A * 8/1986 Gallegos del Bosque ... 123/574
5,239,972 A * 8/1993 Takeyama et al. ..... 123/573
6,148,806 A * 11/2000 Mueller ..... 123/572
6,557,536 B2 * 5/2003 Burgess ..... 123/572
6,591,820 B2 * 7/2003 Kitano et al. ..... 123/572

FOREIGN PATENT DOCUMENTS

| | | | |
|---|---|---|---|
| DE | 198 01 608 | A1 | 7/1999 |
| DE | 19801608 | A | 7/1999 |
| JP | 59208116 | A | 11/1984 |
| JP | 59 208 116 | | 11/1984 |
| JP | 09088542 | A | 3/1997 |
| JP | 11101119 | A | 4/1999 |
| WO | WO 0190540 | A | 11/2001 |

* cited by examiner

*Primary Examiner*—Marguerite McMahon
(74) *Attorney, Agent, or Firm*—John J Cheek

(57) ABSTRACT

In prior art engine breather systems, shut off valves that prevent oil from entering the engine induction system have been mounted externally on the engine and require associated external pipework. Both the shut off valve and pipework are prone to damage and leaking. The closed circuit breather apparatus of the present invention includes a cylinder head cover and a shut off valve provided beneath the cylinder head cover. The shut off valve includes an aperture in communication with a blow-by gas inlet passage and a valve float restrained to move between a first position in which the aperture is open and a second position in which the aperture is closed. Preferably the shut off valve is integral with the cylinder head cover. The shut off valve is thus packaged inside the engine valve chamber, making it easy to fit and eliminating leak paths.

15 Claims, 3 Drawing Sheets

COMBINED SHUT-OFF VALVE AND COVER FOR AN ENGINE BREATHER SYSTEM

TECHNICAL FIELD

This invention relates to breather systems in internal combustion engines which allow the free flow of bypass gases and air movement between chambers of the engine during engine running, and to shut-off valves provided in such breather systems to prevent oil in the breather system from entering the engine induction system, and is particularly but not exclusively applicable to closed circuit breather systems.

BACKGROUND

An internal combustion engine typically has three chambers, the crankcase, the timing case and the top cover. Each of these chambers must be openly connected to allow free flow of bypass gases and air movement during engine running. In a closed breather system blow-by gas escapes past the piston into the crankcase where it mixes with airborne oil droplets and is fed back into the engine induction system. The blow-by gas passes through a woven mesh oil separator that separates the oil from the blow-by gas before allowing the oil to return to the sump under gravity. The blow-by gas then continues through a pressure regulation valve to the induction manifold. The pressure regulation valve typically has a spring-loaded diaphragm that closes when the induction depression overcomes the spring load. Positive crankcase pressure opens the diaphragm and allows blow-by gases to escape into the air intake system. Negative crankcase pressure closes the diaphragm and prevents blow-by gases being drawn back into the engine.

In the known closed circuit breather systems there is a reliance on gravity to ensure that oil in the blow-by gases returns to the sump. Under abnormal operating conditions, such as sump overfill or excessive blow-by of oil arising from a worn engine, there is a risk that oil may not return to the sump, but may be directed to the pressure regulation valve and hence to the engine induction system by gravity, resulting in undesirable engine emissions. If the engine is mounted in a vehicle or machine that is operated at an extreme inclination or rolls over, there is a risk that substantial quantities of oil can flow under gravity and enter the engine induction system. This can cause the engine to run in an ungoverned condition and can result in damage to the engine as well as undesirable engine emissions.

The present invention seeks to provide a shut-off valve for a breather system that overcomes one or more of these problems.

SUMMARY OF THE INVENTION

According to one aspect of this invention, a closed circuit breather apparatus for an engine breather system comprises a cylinder head cover and a shut off valve provided beneath the cylinder head cover. The shut off valve includes an aperture in communication with a ventilation inlet passage and a valve float restrained to move between a first position in which the aperture is open and a second position in which the aperture is closed.

According to another aspect of this invention, a closed circuit breather apparatus for an engine breather system comprises a cylinder head cover adapted to define an engine valve chamber and a shut off valve provided within the engine valve chamber. The shut off valve includes an aperture in communication with a ventilation inlet passage and a valve float restrained to move between a first position in which the aperture is open and a second position in which the aperture is closed.

According to still another aspect of this invention, a cylinder head cover arrangement for an internal combustion engine comprises a cylinder head cover and a ventilation inlet passage integral with the cylinder head cover. A breather shut off valve is integral with the cylinder head cover and in communication with the ventilation inlet passage.

Other features and advantages of this invention will become apparent from the following description and the accompanying drawings.

DETAILED DESCRIPTION

Figure 1:
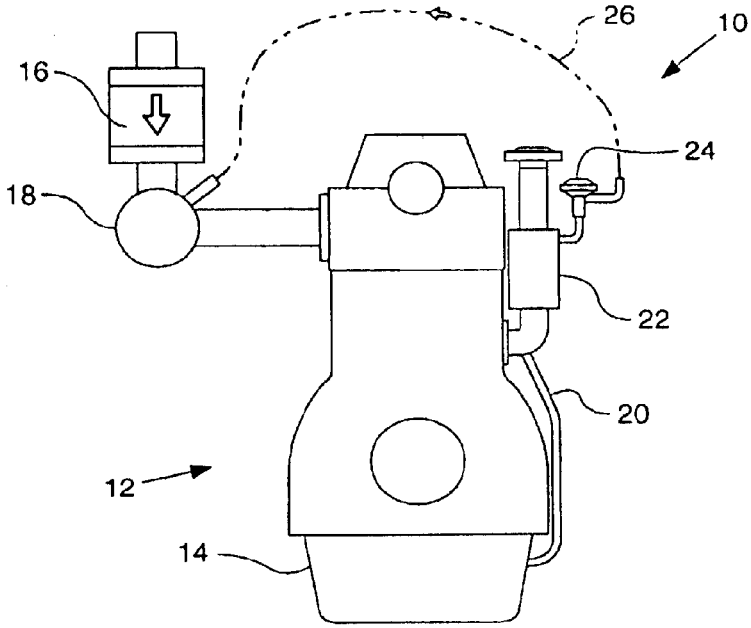
Fig. 1 (PRIOR ART)
FIG. 1 is an end view of an internal combustion engine having a closed circuit breather system according to the prior art, including a pressure regulation valve.
Figure 2:
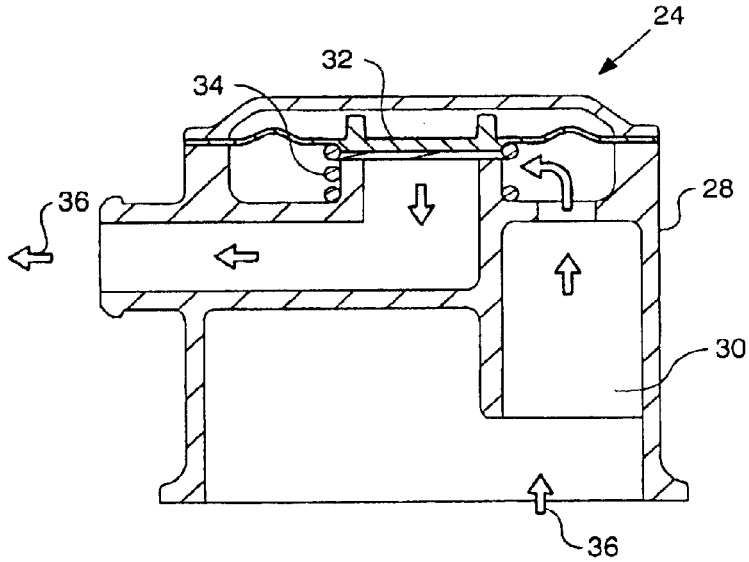
Fig. 2 (PRIOR ART)
FIG. 2 is a cross-sectional view of the pressure regulation valve of FIG. 1.
Figure 3:
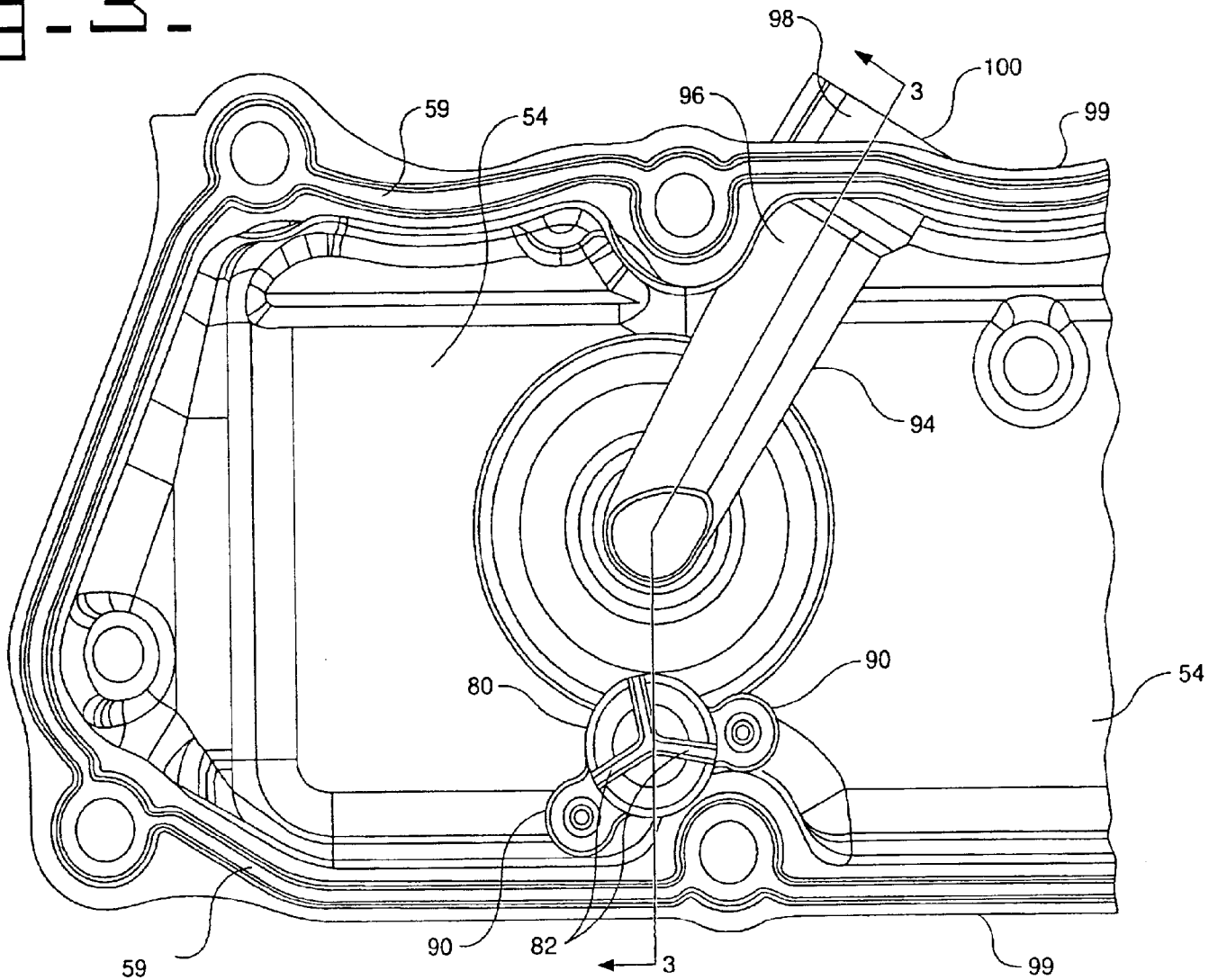
FIG. 3 is a view from below of part of a cylinder head cover including a closed circuit breather apparatus according to a first embodiment of the present invention.

A known closed breather system 10 is shown in FIGS. 1 and 2. An engine 12 has a crankcase 14, an air filter 16 and an induction manifold 18. Blow-by gas which escapes past the pistons (not shown) into the crankcase 14 mixes with airborne oil droplets in the crankcase and is fed back to the engine induction system. The gas first passes through the crankcase breather pipe 20 to a combined filter/separator 22 that separates the oil from the blow-by gas before allowing the oil to return to the crankcase 14 under gravity. The blow-by gas then continues through a pressure regulation valve 24 and along an air intake pipe 26 to the induction manifold 18. The closed breather system shown in FIG. 1 does not include a shut-off valve.

The pressure regulation valve 24 is shown in more detail in FIG. 2 and has a housing 28 with a crankcase inlet 30 connected to the crankcase breather pipe 20 via the combined filter/separator 22 and an induction manifold outlet connected to the air intake pipe 26. Mounted in the housing 28 is a spring-loaded diaphragm 32 that closes when the induction depression overcomes the load in the spring 34. Positive crankcase pressure opens the diaphragm 32 to the position shown in FIG. 2, thereby allowing blow-by gases to escape into the air intake system along the path indicated by the arrows 36. Negative crankcase pressure closes the diaphragm 32 and prevents blow-by gases being drawn back into the engine.

One embodiment of a closed circuit breather apparatus 50 according to the invention is described with reference to FIGS. 3 to 6, by way of example only. The closed circuit breather apparatus 50 includes a pressure regulation valve 52 similar to the pressure regulation valve 24 shown in FIG.

2, but it is to be understood that the pressure regulation valve 52 may be omitted or may be provided separately. The closed circuit breather apparatus 50 includes a cylinder head cover 54, which in use covers the cylinder head 56, thereby enclosing the valves (not shown) and valve operating mechanism 57 within the engine valve chamber 58. A gasket 59 seals the cylinder head cover 54 to the walls of the cylinder head 56. The valve operating mechanism 57 may be any suitable mechanism, such as a rocker shaft, an electrically operated mechanism or a hydraulically operated mechanism.

The pressure regulation valve 52 is mounted within the cylinder head cover 54 and includes a cover plate 60 beneath which is a spring-loaded diaphragm 62 which closes when the induction depression overcomes the load in the spring 64. Positive crankcase pressure opens the diaphragm 62 to the position shown in FIG. 4, thereby allowing blow-by gases to pass into the air intake system along the path indicated by the arrows 66.

The closed circuit breather apparatus 50 includes a ventilation inlet passage 68 and a ventilation outlet passage 70, which convey blow-by gases through the pressure regulation valve 52. A connecting aperture 72 connects a shut off valve 74 to the gas inlet passage 68. The shut off valve 74 includes a valve float 76 movably held in a guide cage 78 comprising an upper cylinder 80 and three lower legs 82 which project downwardly from the cylinder 80. The cylinder 80 has a valve seat 84 at its upper end. The connecting aperture 72 is provided in the valve seat 84. The lower legs 82 are connected at their lower ends to form a seat 86 that limits the downward travel of the valve float 76 in the guide cage 78.

Screws or other suitable fixings (not shown) pass through apertures 88 in a flange 90 connected to the guide cage 78, in order to secure the shut off valve 74 to the cylinder head cover 54. Alternatively the guide cage 78 may be formed integrally with the cylinder head cover 54, or fixed by any other suitable means. The form of the guide cage 78 may vary, for example it may have a different number of legs 82, and the legs may extend the full height of the guide cage 78. The valve float 76 has a density less than that of oil, so that it is able to float on any oil 92 entering the engine valve chamber 58. The valve float 76 may be a ball float, for example a hollow ball of plastic or metal, or any other suitable construction.

Figure 4:
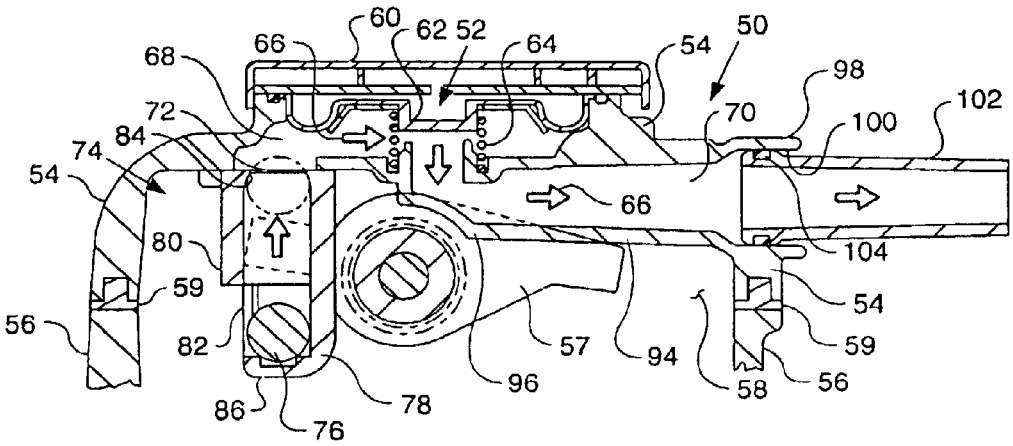
FIG. 4 is a cross-sectional view on line X—X of the closed circuit breather apparatus of FIG. 3 with the shut off valve in an open position.
Figure 5:
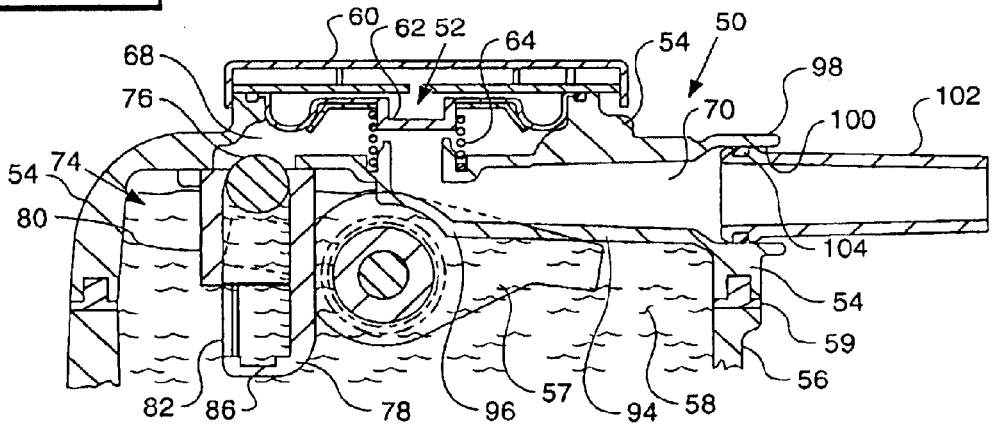
FIG. 5 is a cross-sectional view on line X—X of the closed circuit breather apparatus of FIG. 3 with the shut off valve in a closed position.
Figure 6:
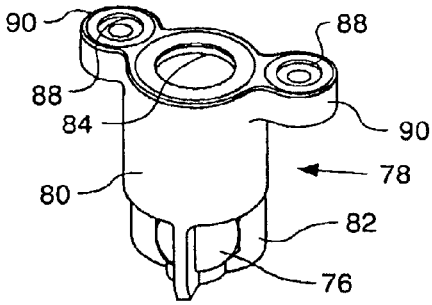
FIG. 6 is a detailed view of the shut off valve of the closed circuit breather apparatus of FIG. 3.

The ventilation outlet passage 70 comprises a tapering outlet passage 94, which is formed integrally with the cylinder head cover 54. A first portion 96 of the outlet passage 94 extends beneath the cylinder head cover 54, best seen in FIG. 3 in which the rocker shaft 57 is omitted for clarity. A second portion 98 of the outlet passage 94 extends through the side wall 99 of the cylinder head cover 54 to an outlet 100 positioned outside the cylinder head cover 54. In the example of FIGS. 4 and 5 a pipe 102 is connected by a seal 104 to the outlet 100. The pipe 102 is in communication with the induction chamber (not shown) of the engine. Other forms of connection may be made to the outlet 100.

INDUSTRIAL APPLICABILITY

The closed circuit breather apparatus 50 of the present invention provides a compact structure for preventing any oil passing through the breather system in the event of oil entering the engine valve chamber 58, and for reducing the carryover of oil droplets into the breather system.

In normal engine operation the valve float 76 sits on the seat 86 in the first position shown in FIG. 4, thereby allowing the passage of blow-by gases up through the vent passages (not shown) from the engine crankcase (not shown), through the connecting aperture 72, into the ventilation inlet passage 68 and along the path indicated by the arrows 66. The shut off valve 74 prevents large oil drops, which are typically greater than 10 microns in size and are present as a result of rocker lever movement in the engine valve chamber 58, from entering the ventilation inlet passage 68. Blow-by gases follow a tortuous path through the shut off valve 74, since they cannot flow straight up through the shut off valve 74 to the aperture 72. As the blow-by gases change direction, oil droplets are deflected onto the guide cage 78 and valve float 76, thereby reducing oil carryover to the engine induction system.

If oil enters the engine valve chamber 58, due to abnormal operating conditions such as such as sump overfill, excessive blow-by of oil arising from a worn engine, or operation of the engine on a gradient, the level of oil 92 will rise. As the level of oil 92 rises the valve float 76 rises until it is seated against the valve seat 84 in a second position shown in FIG. 5, thereby covering the aperture 72 and preventing the passage of blow-by gases through the connecting aperture 72 into the ventilation inlet passage 68.

If the engine overturns the valve float 76 will fall under gravity until it is seated against the valve seat 84 in the second position shown in FIG. 5, even before the engine valve chamber 58 fills with oil, thereby covering the aperture 72 and preventing the passage of oil through the connecting aperture 72 into the ventilation inlet passage 68.

The shut off valve 74 thus prevents oil in the closed circuit breather system from entering the engine induction system, which can cause the engine to run in an ungoverned condition and can result in engine damage.

The closed circuit breather apparatus 50 of the present invention permits the introduction of a shut off valve 74 into an engine breather system without increasing the height of the engine or its components, since the shut off valve 74 is contained within the cylinder head cover 54 and utilizes space in the engine valve chamber 58 which would otherwise be unused. The shut off valve is simple to fit, is not positioned outside the engine where it is susceptible to damage, does not require associated external pipework and eliminates potential leak paths.

It is to be understood that the geometric arrangement of the shut off valve 74 and the inlet and outlet passages 68, 70 may be varied to suit the layout of the engine, as will be apparent to the person skilled in the art. The cylinder head cover 54 may be a complete cover, a top cover or a part cover. The material of the shut off valve 74 and the cylinder head cover 54 can be any suitable material, for example aluminum, alloy, pressed steel, composite material, thermosetting plastic or thermoplastic. The shut off valve 74 may be formed integrally with the cylinder head cover 54, or may be formed separately and then attached to the cylinder head cover 54 to form an integral unit. Other modifications may be made within the scope of the appended claims.

What is claimed is:

1. A closed circuit breather apparatus for an engine breather system comprising:

a cylinder head cover; and a shut off valve provided beneath the cylinder head cover, the shut off valve including an aperture in communication with a ventilation inlet passage and a valve float restrained to move between a first position in which the aperture is open and a second position in which the aperture is closed;

wherein said shut off valve further includes a guide cage that restrains the valve float for movement between the first and second positions.

2. A closed circuit breather apparatus according to claim 1, wherein the guide cage is fixed to the underside of the cylinder head cover.

3. A closed circuit breather apparatus according to claim 1, wherein the valve float is a ball float and covers the aperture when the valve float is in the second position.

4. A closed circuit breather apparatus according claim 2, wherein the valve float is a ball float and covers the aperture when the valve float is in the second position.

5. A closed circuit breather apparatus for an engine breather system comprising:

a cylinder head cover;

a shut oft valve provided beneath the cylinder head cover, the shut off valve including an aperture in communication with a ventilation Inlet passage and a valve float restrained to move between a first position in which the aperture is open and a second position in which the aperture Is closed; and a pressure regulation valve In communication with the ventilation inlet passage.

6. A closed circuit breather apparatus according to claim 1, further including a pressure regulation valve in communication with the ventilation inlet passage.

7. A closed circuit breather apparatus according to claim 2, further including a pressure regulation valve in communication with the ventilation inlet passage.

8. A closed circuit breather apparatus according to claim 5, further including an outlet passage in communication with the pressure regulation valve, the outlet passage having a first portion provided beneath the cylinder head cover and a second portion extending through the cylinder head cover to an outlet outside the cylinder head cover.

9. A closed circuit breather apparatus according to claim 6, further including an outlet passage in communication with the pressure regulation valve, the outlet passage having a first portion provided beneath the cylinder head cover and a second portion extending through the cylinder head cover to an outlet outside the cylinder head cover.

10. A closed circuit breather apparatus according to claim 7, further including an outlet passage in communication with the pressure regulation valve, the outlet passage having a first portion provided beneath the cylinder head cover and a second portion extending through the cylinder head cover to an outlet outside the cylinder head cover.

11. A closed circuit breather apparatus according to claim 1, further including an outlet passage in communication with the pressure regulation valve, the outlet passage having a first portion provided beneath the cylinder head cover and a second portion extending through the cylinder head cover to an outlet outside the cylinder head cover.

12. A closed circuit breather apparatus for an engine breather system comprising:

a cylinder head cover adapted to define an engine valve chamber; and a shut off valve provided within the engine valve chamber, the shut off valve including an aperture in communication with a ventilation inlet passage and a valve float restrained to move between a first position in which the aperture is open and a second position in which the aperture is closed;

wherein the shut off valve includes a guide cage that restrains the valve float for movement between the first and second positions.

13. A closed circuit breather apparatus according to claim 12, wherein the guide cage is fixed to the underside of the cylinder head cover.

14. A closed circuit breather apparatus for an engine breather system comprising:

a cylinder head cover adapted to define an engine valve chamber;

a shut off valve provided within the engine valve chamber, the shut off valve including an aperture in communication with a ventilation inlet passage and a valve float restrained to move between a first position in which the aperture is open and a second position in which the aperture is closed; and a pressure regulation valve in communication with the ventilation inlet passage.

15. A cylinder head cover arrangement for an internal combustion engine, comprising:

a cylinder head cover;

a ventilation inlet passage integral with said cylinder head cover;

a breather shut off valve integral with said cylinder head cover and in communication with said ventilation inlet passage;

a ventilation outlet passage integral with said cylinder head cover; and a pressure regulation valve in communication with said ventilation inlet passage and said ventilation outlet passage.

* * * * *

UNITED STATES PATENT AND TRADEMARK OFFICE

CERTIFICATE OF CORRECTION

PATENT NO. : 6,889,674 B2
DATED : May 10, 2005
INVENTOR(S) : Richard Pateman et al.

It is certified that error appears in the above-identified patent and that said Letters Patent is hereby corrected as shown below:

Column 5,
Line 13, delete "oft" and insert -- off --
Line 15, delete "Inlet" and insert -- inlet --
Line 18, delete "Is" and insert -- is --
Line 19, delete "In" and insert -- in --

Signed and Sealed this

Second Day of August, 2005

JON W. DUDAS
*Director of the United States Patent and Trademark Office*